US005820178A

United States Patent [19]

Ellis et al.

[11] Patent Number: 5,820,178

[45] Date of Patent: Oct. 13, 1998

[54] SPRING RETAINER FOR LOCK MECHANISM

[75] Inventors: Philip C. Ellis, Reading; Leslie A. Meck, Fleetwood, both of Pa.

[73] Assignee: Baldwin Hardware Corporation, Reading, Pa.

[21] Appl. No.: 921,108

[22] Filed: Aug. 29, 1997

Related U.S. Application Data

[63] Continuation of Ser. No. 684,365, Jul. 19, 1996, abandoned.

[51] Int. Cl.[6] ..... E05B 3/00

[52] U.S. Cl. ..... 292/336.3; 292/347; 292/356; 292/DIG. 61

[58] Field of Search ..... 292/336.3, 358, 292/347, DIG. 61, 356, 138, 164

[56] References Cited

U.S. PATENT DOCUMENTS

| | | | |
|---|---|---|---|
| 1,929,658 | 10/1933 | Solliday et al. . | |
| 3,075,796 | 1/1963 | Russell et al. . | |
| 3,083,400 | 4/1963 | Williams . | |
| 4,820,330 | 4/1989 | Lin . | |
| 4,852,922 | 8/1989 | Shih . | |
| 4,903,512 | 2/1990 | Leroy . | |
| 4,998,760 | 3/1991 | Nixon et al. | 292/336.3 |
| 5,027,629 | 7/1991 | Liu . | |
| 5,177,987 | 1/1993 | Shen | 292/336.3 |
| 5,265,453 | 11/1993 | Konii et al. . | |
| 5,265,924 | 11/1993 | Kim . | |
| 5,286,074 | 2/1994 | Lin | 292/336.3 |
| 5,316,355 | 5/1994 | Hartwell et al. | 292/356 |
| 5,322,333 | 6/1994 | Norton, II et al. . | |
| 5,335,948 | 8/1994 | Norton, II et al. | 292/336.3 |
| 5,335,950 | 8/1994 | Mirshafiee | 292/356 |
| 5,441,318 | 8/1995 | Ghostley | 292/356 |
| 5,481,890 | 1/1996 | Millman | 292/336.3 |
| 5,529,354 | 6/1996 | Studt et al. | 292/61 |

*Primary Examiner*—Rodney M. Lindsey
*Attorney, Agent, or Firm*—Edgar A. Zarins; Malcolm L. Sutherland

[57] ABSTRACT

A retainer for preventing abrasion of a lock spindle of a lock mechanism by a torsion spring used to return the lock assembly the center position. The lock mechanism includes an axial spindle operably connected to the knob and the lock bolt for selective operation. The torsion spring which returns the lock assembly to the center or at-rest position is coaxially mounted about the spindle. The retainer includes tabs disposed between the spring and the spindle to prevent contact therebetween and thereby eliminate abrasion of the spindle by the spring which can result in premature failure of the lock mechanism.

7 Claims, 2 Drawing Sheets

SPRING RETAINER FOR LOCK MECHANISM

This application is a continuation of application Ser. No. 08/684,365, filed Jul. 19, 1996, now abandoned.

BACKGROUND OF THE INVENTION

I. Field of the Invention

This invention relates to a retainer member for maintaining separation of a torsion spring from a coaxial lock spindle of a lock mechanism thereby preventing abrasion of the spindle during operation of the lock.

II. Description of the Prior Art

Typical lock mechanisms include a lock spindle extending through the door operably connected to the inner and outer door knobs or levers. Rotation of the spindle operates the latch bolt facilitating selective entry through the door passageway. In the class of door hardware known as "bored-through locks", the most common method of construction is a tubular latch captured transversely by zinc die cast adaptors. The adaptors function as bearings for the spindles which operate the latch. A torsion spring coaxially mounted to the spindle acts against the adaptor and the spring retainer attached to the spindle to return the spindle to the center position. The retainer includes a center aperture configured to receive and rotate with the spindle. Accordingly, as the knob or lever is rotated the latch bolt is withdrawn and the spring causes the spindle and knob to return to the center position with the bolt extended.

In the prior known lock mechanisms, the spindles are made of a stamped steel. Zinc die cast spindles, however, can incorporate mechanical features which are difficult to produce in a stamping. Unfortunately, it has been shown that the torsion spring abrades the softer zinc during operation of the lock mechanism.

SUMMARY OF THE PRESENT INVENTION

The present invention overcomes the disadvantages of the prior known lock assemblies by providing a spring retainer rotatably mounted to the lock spindle for biasing a torsion spring and including inner tabs to shield the spindle against abrasion by the spring during operation of the lock assembly.

A lock assembly includes an axial lock spindle to which the door knob or lever is operably connected and which cooperates with the latch bolt for selective retraction and extension of the bolt. Operation of the lock assembly is biased against an inner torsion spring coaxially mounted to the spindle to bias the lock to the natural at-rest position with the latch bolt extended. A retainer plate secured to the spindle includes outer tabs to engage the arms of the torsion spring applying tension as the spindle and therefore the retainer plates are rotated. Upon release, the tension of the spring biases the spindle to the center position whereby the latch bolt is extended.

In a preferred embodiment of the present invention, the spindle is a zinc die. In order to shield the softer spindle from damage, the retainer plate includes inner tabs which extend radially inwardly of the torsion spring. The tabs extend between the spring and spindle preventing abrasive contact by the spring against the spindle.

Other objects, features and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
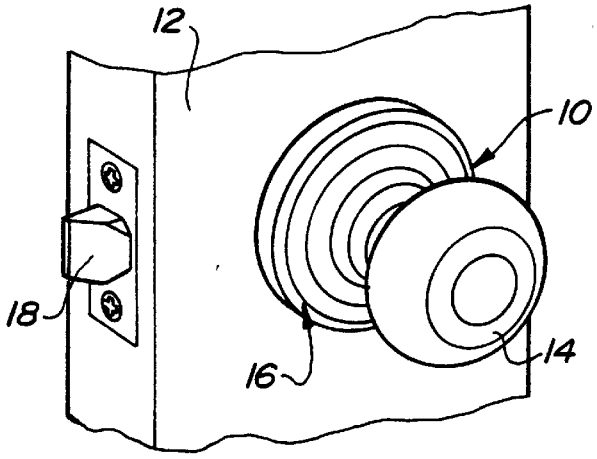
FIG. 1 is a perspective view of a lock assembly embodying the present invention mounted within a door.

Referring first to FIG. 1, there is shown a lock assembly 10 mounted to a door 12 in order to permit selective entry through the door passageway. The lock assembly 10 is shown with a door knob 14 although it shall be understood that a lever may be interchangeably used on the lock assembly 10. The door knob 14 is operably connected to an internal lock mechanism 16 which operates a latch bolt 18 extending laterally from the edge of the door 12. Rotation of the door knob 14 will retract the latch bolt 18 to withdraw the bolt 18 from the door jamb allowing opening of the door 12.

Figure 2:
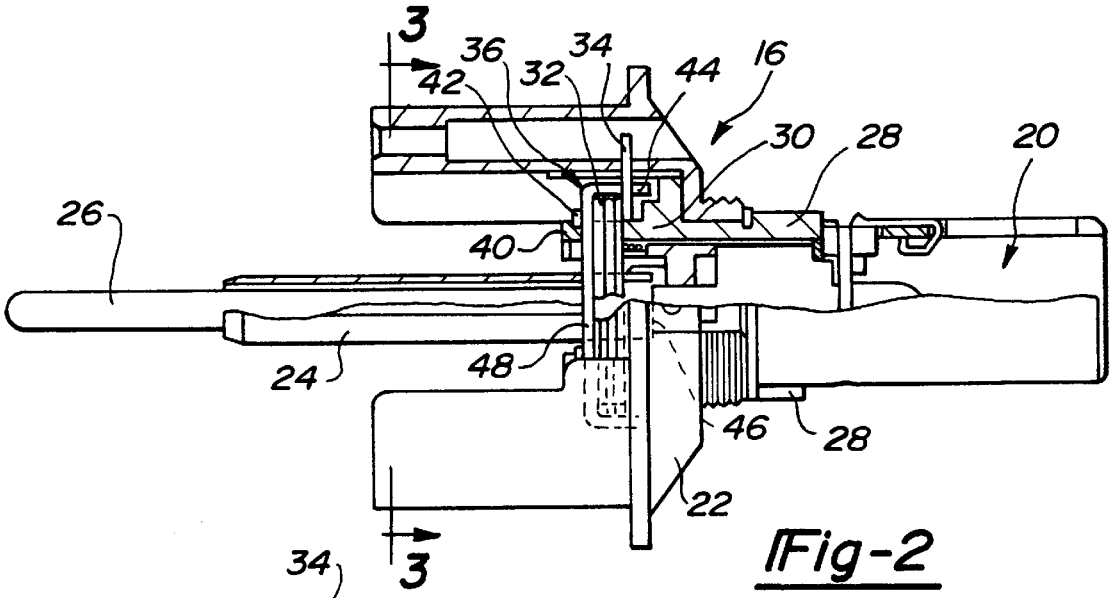
FIG. 2 is a partial cross-sectional view of the lock assembly.
Figure 3:
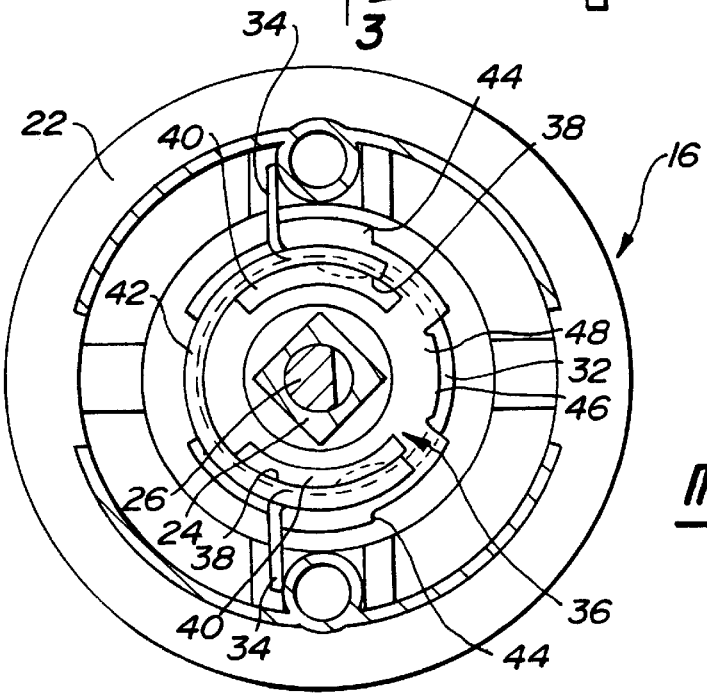
FIG. 3 is an end view from the interior of the lock assembly taken along line 3—3 of FIG. 2.
Figure 4:
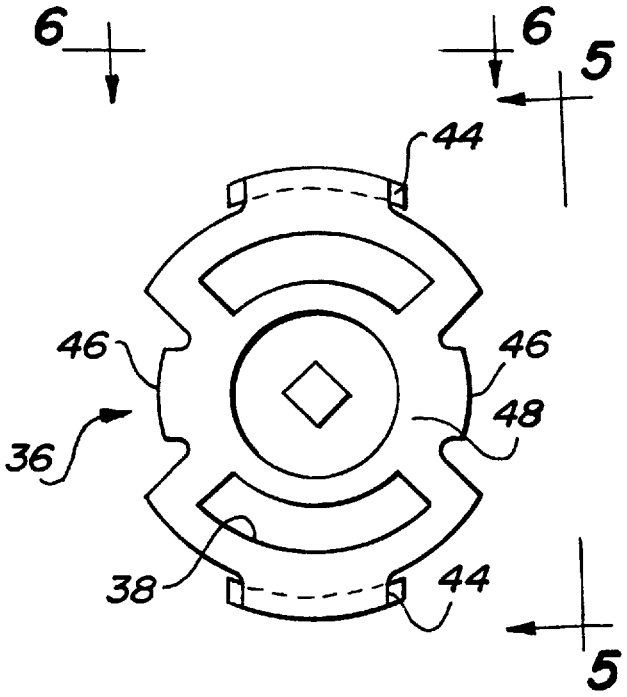
FIG. 4 is a face view of a spring retainer for the lock assembly.
Figure 5:
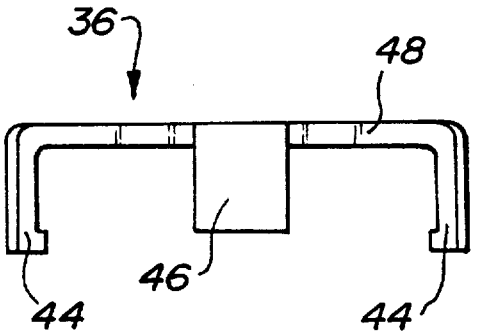
FIG. 5 is a first side view of the spring retainer taken along line 5—5 of FIG. 4.
Figure 6:
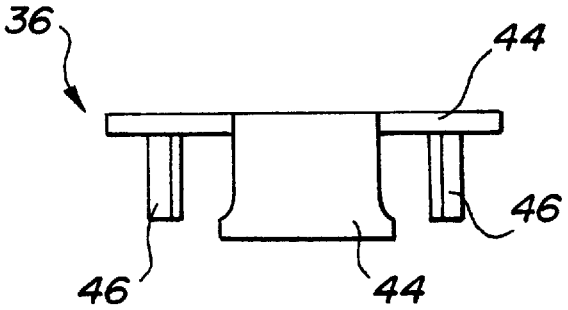
FIG. 6 is a second side view of the spring retainer taken along line 6—6 of FIG. 4.

Referring now to FIGS. 2 and 3, the lock mechanism 16 includes an axial lock spindle 20 to which the door knob 14 is attached. The lock spindle 20 is coaxially supported within a trim adaptor 22 which facilitates mounting of the lock assembly 10 to the door 12. Matingly received within an interior end of the spindle 20 is a drive tube 24 and tail piece 26 which rotate with the lock spindle 20 to drive the latch bolt 14 and inner door knob, respectively. The lock spindle 20 has a substantially tubular configuration to receive a lock cylinder (not shown) and includes lugs 28 formed on an outer surface thereof which drivingly engage the door knob assembly 14. Preferably, the lock spindle 20 is a zinc die casting which permits the manufacture of greater detail over a stamped spindle, including the lugs 28 and flanges forming a part of the lock construction.

Coaxially mounted to an interior end 30 of the lock spindle 20 is a torsion spring 32. The spring 30 includes arms 34 which extend radially outwardly to engage the trim adaptor 33 providing the biasing force of the torsion spring 32. In order to retain the torsion spring 32 and to bias the spring 32 as the spindle 20 is rotated, a spring retainer 36 is mounted to the interior end 30 of the spindle 20. The retainer 36 includes arcuate openings 38 adapted to receive lugs 40 formed at the interior end 30 of the spindle 20. As a result, rotation of the spindle 20 is translated to the retainer 36 through the lugs 40. A c-ring 42 attached to the lugs 40 holds the retainer 36 on the interior end 30 of the spindle 20.

Referring now to FIGS. 2 through 6, the spring retainer 36 includes radially outer tabs 44 and radially inwardly disposed inner tabs 46 formed substantially perpendicular to a body portion 48 of the retainer 36. A keyed aperture 50, preferably a square opening, is formed in the center of the body portion 48 to matingly receive the similarly configured drive tube 24 for rotation of the spring retainer in conjunction with the drive tube 24. Upon mounting the torsion spring 32 to the interior end 30 of the spindle 20 and positioning the spring retainer 36 over the end 30, the outer tabs 44 are positioned radially outwardly of the torsion spring 32. As the spindle 20 and therefore the retainer 36 are rotated during operation of the lock assembly 10, one or the other of the outer tabs 44 will act upon the corresponding arm 34 of the spring 32, depending upon the direction of rotation, against the bias of the spring 32. Upon release, the spring 32 will cause the spindle 20 and therefore the lock assembly 10 to return to the center, at-rest position.

Rotation of the spindle 20 will cause contraction of the torsion spring 32 around the spindle 20. This contraction may cause the spring 32 to contact or rub against the spindle 20. In the case of softer materials such as the zinc die cast spindle of the present invention, the spring 32 can damage the spindle 20 resulting in eventual failure of the lock assembly 10. In order to prevent abrasion of the spindle 20 by the spring 32, the spring retainer 36 is provided with the inner tabs 46 which are disposed between the spring 32 and the spindle 20. As the spring 32 contracts it will engage the inner tabs 46 of the retainer 36 thus shielding the spindle 20 from abrasion by the spring 32. Nevertheless, the torsion spring 32 and spring retainer 36 cooperate to return the lock assembly 10 to the at-rest position following rotation of the door knob 14 to retract the bolt 18.

The foregoing detailed description has been given for clearness of understanding only and no unnecessary limitations should be understood therefrom as some modifications will be obvious to those skilled in the art without departing from the scope and spirit of the appended claims.

What is claimed is:

1. A lock mechanism comprising:

an axial lock spindle having lugs extending longitudinally therefrom and a torsion spring mounted thereto for biasing said lock spindle towards a first position; and a spring retainer connected to said lock spindle and said torsion spring, said spring retainer including:

a substantially planar retainer body having arcuate slots for connecting slots for connecting said retainer to the lock spindle for rotation therewith;

a pair of outer tabs circumferentially spaced along a peripheral edge and extending from said planar retainer body to engage the torsion spring whereby rotation of the spindle applies biasing tension to the torsion spring; and a pair of radially inner tabs extending from and spaced around said retainer body at right angles to said outer tabs, said inner tabs disposed between the torsion spring and the lock spindle upon connecting said retainer to the lock spindle to maintain separation between the torsion spring and lock spindle thereby shielding the lock spindle from engagement by said torsion spring.

2. In a lock mechanism mounted within a door for controlling passage through the door, the lock mechanism including an axial spindle operably connected to a knob assembly and having a torsion spring mounted to the spindle for biasing the spindle to a neutral position, the improvement comprising:

a retainer mounted to the lock spindle for rotation therewith, said retainer including a planar retainer body with arcuate openings to receive the lock spindle, a pair of outer tabs spaced along an outer periphery of said retainer body and extending substantially perpendicular to said retainer body engaging the torsion spring for applying biasing tension to the torsion spring upon rotation of the lock spindle and said retainer, and a pair of radially spaced inner tabs disposed radially inwardly of said outer tabs extending substantially perpendicular to said retainer body parallel with said outer tabs, said inner tabs disposed at right angles to said outer tabs between the torsion spring and lock spindle to maintain separation therebetween thereby preventing abrasion of the lock spindle by the torsion spring.

3. The improvement as defined in claim 2 wherein said retainer body includes a central aperture receiving a drive tube of the lock mechanism.

4. The improvement as defined in claim 2 wherein said outer tabs are offset from said inner tabs.

5. The improvement as defined in claim 4 wherein said outer tabs are disposed substantially perpendicular to said inner tabs.

6. A lock mechanism mounted within a door for controlling passage through the door, said lock mechanism comprising:

an axial lock spindle having arcuate end tabs;

a spring retainer having arcuate openings for receiving said arcuate end tabs for mounting said retainer to said lock spindle; and a torsion spring disposed within said spring retainer for biasing said spring retainer and lock spindle towards a first position;

said spring retainer including a planar retainer body having said arcuate openings for mounting to said lock spindle for rotation therewith, a pair of outer tabs circumferentially spaced extending perpendicular to said planar retainer body and engaging said torsion spring for applying biasing tension to said torsion spring upon rotation of said lock spindle and said retainer, and a pair of spaced apart inner tabs extending perpendicular to said planar retainer body substantially parallel to said outer tabs, said inner tabs disposed radially inwardly of and at right angles to said outer tabs and extending between the torsion spring and lock spindle to maintain separation between the torsion spring and lock spindle thereby shielding the lock spindle from engagement by said torsion spring.

7. The lock mechanism as defined in claim 6 wherein said inner and outer tabs are integrally formed with said planar body bent perpendicular to said body.

* * * * *